US010807824B2

(12) United States Patent
Furumido et al.

(10) Patent No.: US 10,807,824 B2
(45) Date of Patent: Oct. 20, 2020

(54) MEDIUM TRANSPORTING APPARATUS AND POST-PROCESSING APPARATUS

(71) Applicant: SEIKO EPSON CORPORATION, Tokyo (JP)

(72) Inventors: Tsuyoshi Furumido, Shiojiri (JP); Kazunori Mori, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/366,017

(22) Filed: Mar. 27, 2019

(65) Prior Publication Data

US 2019/0299667 A1 Oct. 3, 2019

(30) Foreign Application Priority Data

Mar. 30, 2018 (JP) ..... 2018-069990

(51) Int. Cl.
*B65H 31/02* (2006.01)
*B65H 31/30* (2006.01)
(Continued)

(52) U.S. Cl.
CPC ..... *B65H 31/02* (2013.01); *B65H 29/242* (2013.01); *B65H 29/56* (2013.01); *B65H 31/3027* (2013.01); *B65H 31/36* (2013.01); *B65H 2301/4212* (2013.01); *B65H 2301/4213* (2013.01); *B65H 2301/4474* (2013.01);
(Continued)

(58) Field of Classification Search
CPC .... B65H 31/02; B65H 31/3027; B65H 29/56; B65H 29/242; B65H 31/36; B65H 2406/323; B65H 2801/27; B65H 2301/4212; B65H 2404/2641; B65H 2301/4474; B65H 2301/4213;
(Continued)

(56) References Cited

U.S. PATENT DOCUMENTS

2005/0035527 A1* 2/2005 Oomori ..... B65H 1/00 271/10.09
2017/0068202 A1 3/2017 Nakano et al.
(Continued)

FOREIGN PATENT DOCUMENTS

EP 3269555 A 1/2018
JP S63-11764 A 7/1988
(Continued)

*Primary Examiner* — Geoffrey S Mruk
(74) *Attorney, Agent, or Firm* — Workman Nydegger

(57) ABSTRACT

A medium transporting apparatus includes a transport belt that has a loop shaped, an clinging mechanism that causes a medium to cling to the transport belt, a rotation mechanism that rotates the transport belt in a first and second rotation direction, and an intermediate stacker on which the medium transported by the transport belt is stacked, in which the clinging mechanism cling an upper surface that is opposite to a lower surface of the medium on the intermediate stacker side, and after rotating the transport belt, to which the medium is cling, in the first rotation direction to transport the medium in a first transport direction, the rotation mechanism rotates the transport belt in the second rotation direction to transport the medium in a second transport direction that is opposite to the first transport direction so as to stack the medium on the intermediate stacker.

6 Claims, 10 Drawing Sheets

(51) Int. Cl.
*B65H 29/56* (2006.01)
*B65H 29/24* (2006.01)
*B65H 31/36* (2006.01)

(52) U.S. Cl.
CPC ..... *B65H 2301/44734* (2013.01); *B65H 2403/942* (2013.01); *B65H 2404/2641* (2013.01); *B65H 2405/11151* (2013.01); *B65H 2406/323* (2013.01); *B65H 2801/27* (2013.01)

(58) Field of Classification Search
CPC ..... B65H 2301/44734; B65H 2405/11151; B65H 2403/942
See application file for complete search history.

(56) References Cited

U.S. PATENT DOCUMENTS

| | | | |
|---|---|---|---|
| 2018/0015737 | A1 | 1/2018 | Harada et al. |
| 2018/0015738 | A1 | 1/2018 | Kodama et al. |
| 2018/0141775 | A1 | 5/2018 | Watanabe et al. |

FOREIGN PATENT DOCUMENTS

| | | | |
|---|---|---|---|
| JP | H11-334943 | A | 12/1999 |
| JP | 2004-269115 | | 9/2004 |
| JP | 2008-266020 | A | 11/2008 |
| WO | 2016199590 | A | 12/2016 |

* cited by examiner

MEDIUM TRANSPORTING APPARATUS AND POST-PROCESSING APPARATUS

CROSS REFERENCES TO RELATED APPLICATIONS

The entire disclosure of Japanese Patent Application No. 2018-069990, filed Mar. 30, 2018 is expressly incorporated by reference herein.

BACKGROUND

1. Technical Field

The present disclosure relates to a medium transporting apparatus that transports a medium and a post-processing apparatus including the medium transporting apparatus.

2. Related Art

There is an integrated device disclosed in JP-A-2008-266020 as an example of a post-processing apparatus. The integrated device includes a suction conveyor that sucks and transports a lithographic printing plate as an example of a medium from above. The suction conveyor drops the suction-transported lithographic printing plate from above and accumulates the lithographic printing plate on an accumulation stand which is an example of a stacker.

When a medium recorded by a printing device that performs recording by ejecting a liquid is stacked on a stacker using a technology disclosed in JP-A-2008-266020, a problem unique to the medium recorded by the printing device using the liquid occurs. That is, due to sliding resistance between the media to which the liquid adheres, there is a possibility that the discharged following medium may not slide smoothly with respect to the preceding medium already stacked on the stacker and alignment of the following medium deteriorates.

SUMMARY

An advantage of some aspects of the disclosure is to provide a medium processing apparatus and a post-processing apparatus that can ensure alignment even when a medium recorded by ejecting a liquid is stacked on the stacker.

Hereinafter, means of the disclosure and operation effects thereof will be described.

According to an aspect of the disclosure, there is provided a medium transporting apparatus including a transport belt that has a loop shaped, a clinging mechanism that causes a medium to cling to the transport belt, a rotation mechanism that rotates the transport belt in a first rotation direction and a second rotation direction that is opposite to the first rotation direction, and a stacker on which the medium transported by the transport belt is stacked, in which the clinging mechanism cling a second surface that is opposite to a first surface of the medium on the stacker side, and after rotating the transport belt, to which the medium is cling, in the first rotation direction to transport the medium in a first transport direction, the rotation mechanism rotates the transport belt in the second rotation direction to transport the medium in a second transport direction that is opposite to the first transport direction so as to stack the medium on the stacker.

With this configuration, after transporting the medium in the first transport direction, the rotation mechanism transports the medium in the second transport direction and stacks the medium on the stacker. Therefore, a transport speed of the medium is reduced at a timing when the transport direction of the medium is switched from the first transport direction to the second transport direction. Therefore, when the transport direction of the medium is switched from the first transport direction to the second transport direction, a time required for stacking the medium on the stacker is long, as a compared to a case where the medium is stacked on the stacker while the first transport direction is maintained. That is, when the transport direction of the medium is switched from the first transport direction to the second transport direction, a time required for drying a liquid attached to the medium is long. Thus, the discharged following medium is easy to slide on the medium already stacked on the stacker, and improvement of alignment of the following medium can be expected. Therefore, even when the medium recorded by ejecting the liquid is stacked on the stacker, the alignment can be ensured.

It is preferable that the medium transporting apparatus further include a flap that has a flap shaft on an upstream side in the first transport direction, and is swingable between a first position not intersecting a clinging surface to which the medium is cling in the transport belt and a second position intersecting the clinging surface when viewed from a width direction that is perpendicular the first transport direction, and a pressing member that presses the flap toward the second position, in which the flap includes a first flap surface that configured to contact with the first surface of the medium transported in the first transport direction, when the flap is located in the first position, and a second flap surface that configured to contact with the second surface of the medium transported in the second transport direction and detach the medium from the transport belt, when the flap is located in the second position.

With this configuration, since the flap comes into contact with the first surface of the medium transported in the first transport direction, the medium can be stably transported while being interposed between the flap and the transport belt. A second flap surface of the flap intersects the clinging surface of the transport belt when the rotation direction of the transport belt is switched from the first rotation direction to the second rotation direction. Therefore, when the medium is transported in the second transport direction by the transport belt, the second surface comes into contact with the flap, and the medium is detached from the transport belt. Therefore, the transport of the medium and the stacking on the stacker can be more efficiently performed by the flap, of which a posture can be changed.

In the medium transporting apparatus, it is preferable that an angle between the second flap surface and the clinging surface when the transport belt rotates in the second rotation direction be an obtuse angle.

With this configuration, since an angle between the second flap surface and the clinging surface is an obtuse angle, the medium can be easily detached from the transport belt, as compared to a case where an angle between the second flap surface and the clinging surface is an acute angle.

In the medium transporting apparatus, it is preferable that the clinging mechanism causes the medium to cling to the transport belt by a suction unit of sucking air from a hole formed in the transport belt or an electrostatic clinging unit of charging the medium and the transport belt.

With this configuration, the clinging mechanism causes the medium to cling to the transport belt by the suction type and electrostatic clinging type. Therefore, for example, as compared to a case where the medium is transported by a clinging belt, a possibility that the medium is damaged can be reduced.

In the medium transporting apparatus, it is preferable that the stacker include an alignment unit that aligns an end of the medium, and an end of the stacker on the alignment unit side is located lower in a vertical direction than an opposite end of the stacker.

With this configuration, the stacker includes the alignment unit, and an end of the stacker on the alignment unit side is located on a lower side in the vertical direction than an opposite end thereof. Therefore, the alignment when the medium is stacked on the stacker can be further improved.

According to another aspect of the disclosure, there is provided a post-processing apparatus including a transport belt that has a loop shaped, an clinging mechanism that causes a medium to cling to the transport belt, a rotation mechanism that rotates the transport belt in a first rotation direction and a second rotation direction that is opposite to the first rotation direction, an intermediate stacker on which the medium transported by the transport belt is stacked, a post-processing mechanism that performs post-processing on the medium in the intermediate stacker, and a discharge stacker on which the medium transported from the intermediate stacker is stacked, in which the clinging mechanism cling a second surface that is opposite to a first surface of the medium on the intermediate stacker side, and after rotating the transport belt, to which the medium is cling, in the first rotation direction to transport the medium in the first transport direction, the rotation mechanism rotates the transport belt in the second rotation direction to transport the medium in the second transport direction that is opposite to the first transport direction so as to stack the medium on the intermediate stacker. With this configuration, the same effect as the medium processing apparatus can be obtained.

In the post-processing apparatus, it is preferable that the transport belt is displaceable between a contact position where the transport belt is in contact with the medium stacked on the intermediate stacker and a retraction position where the transport belt is separated further away from the intermediate stacker than the contact position, and after the post-processing mechanism performs the post-processing, the rotation mechanism rotates the transport belt located at the contact position in the first rotation direction.

With this configuration, the transport belt is provided to be displaceable between a contact position where the transport belt is in contact with the medium stacked on the intermediate stacker and a retraction position where the transport belt is separated further from the intermediate stacker than the contact position. When the transport belt located at the contact position rotates in the first rotation direction, the medium stacked on the intermediate stacker can be sent out from the intermediate stacker. Therefore, the stacking of the medium on the intermediate stacker and the sending-out of the medium from the intermediate stacker can be performed by the transport belt.

It is preferable that the post-processing apparatus further include a sending-out roller that is displaceable between a contact position where the medium stacked on the intermediate stacker is in contact with the transport belt and a retraction position where the medium is separated further away from the transport belt than the contact position, in which the rotation mechanism rotates, in a state in which the sending-out roller is located at the retraction position, the transport belt in the first rotation direction and the second rotation direction, to stack the medium on the intermediate stacker, and rotates the transport belt in the first rotation direction in a state in which the sending-out roller is located at the contact position, after the post-processing mechanism performs the post-processing.

With this configuration, the sending-out roller is located at a contact position where the medium stacked on the intermediate stacker is in contact with the transport belt and a retraction position where the medium is separated further from the transport belt than the contact position. The sending-out roller located at the contact position sandwiches the medium between the sending-out roller and the transport belt. Therefore, when the transport belt is rotated in the first rotation direction in a state in which the sending-out roller is located at the contact position, the medium is sent out from the intermediate stacker by the transport belt and the sending-out roller.

BRIEF DESCRIPTION OF THE DRAWINGS

The disclosure will be described with reference to the accompanying drawings, wherein like numbers reference like elements.

DESCRIPTION OF EXEMPLARY EMBODIMENTS

First Embodiment

Hereinafter, a medium processing apparatus and a post-processing apparatus according to a first embodiment will be described with reference to the drawings. The medium processing apparatus is an ink jet printer that discharges an ink as an example of a liquid to a medium such as a paper sheet and records a letter or an image on the medium.

Figure 1:
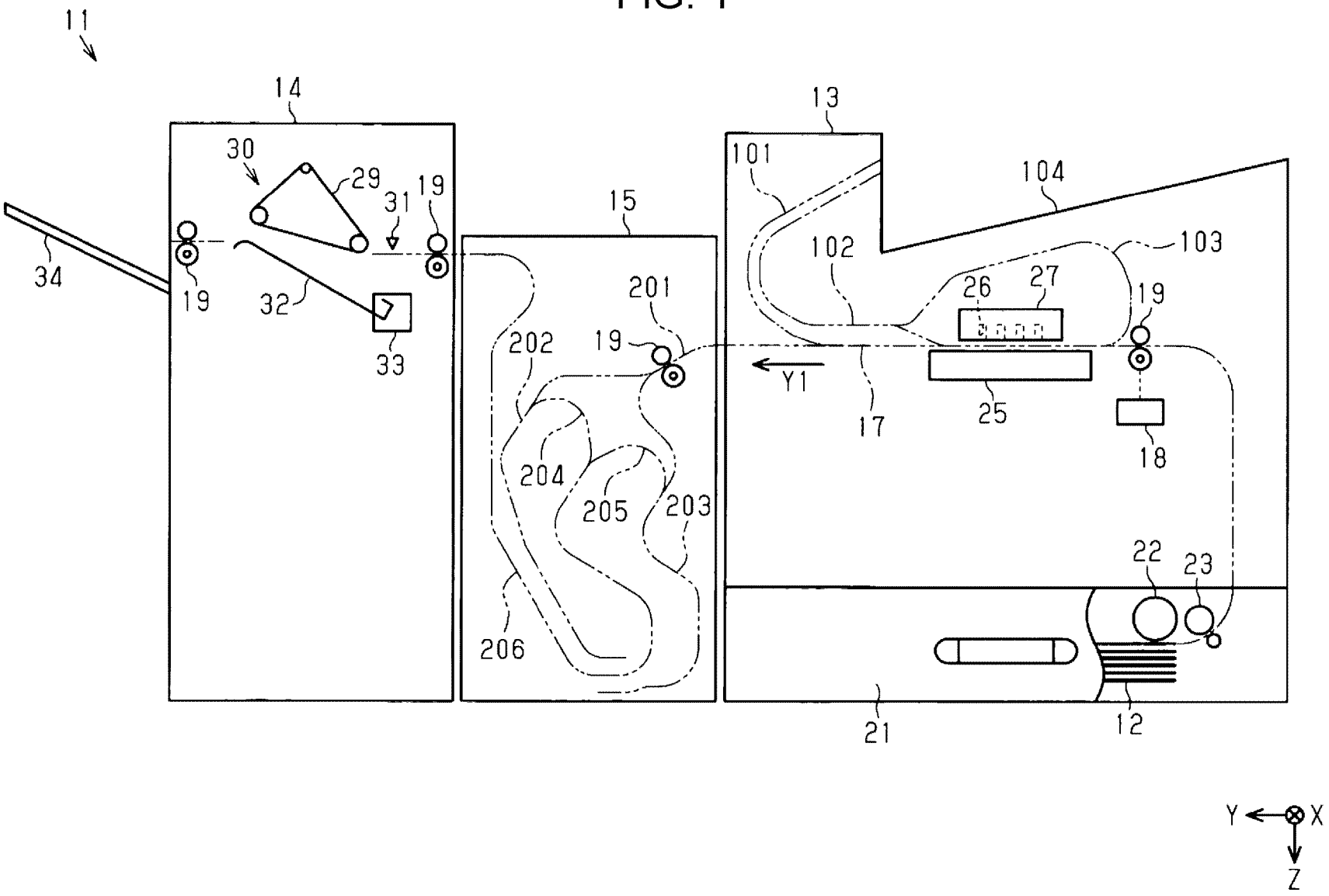
FIG. 1 is a schematic side view illustrating a medium processing apparatus including a post-processing apparatus according to a first embodiment.

As illustrated in FIG. 1, the medium processing apparatus 11 includes a printing device 13 that performs recording on the medium 12, a post-processing apparatus 14 that performs post-processing on the recorded medium 12, and an intermediate device 15 located between the printing device 13 and the post-processing apparatus 14. The post-processing is a process performed accompanying a recording process, and the post-processing apparatus 14 of the present embodiment performs a stapler process of stapling a plurality of recorded media 12.

A transport path 17 continuing from the printing device 13 via the intermediate device 15 to the post-processing apparatus 14 and indicated by a two-dot chain line in FIG. 1 is provided in the medium processing apparatus 11. The medium processing apparatus 11 includes at least one transport roller pair 19 that transports the medium 12 along the transport path 17 by driving the transport motor 18. The transport roller pair 19 may include a transport motor 18 in each of the intermediate device 15 and the post-processing apparatus 14. Further, the printing device 13, the intermediate device 15, and the post-processing apparatus 14 may include a plurality of transport motors 18. Accordingly, operations of the plurality of transport roller pairs 19 in the printing device 13, the intermediate device 15, and the post-processing apparatus 14 can be controlled efficiently.

In the drawing, the medium processing apparatus 11 is placed on a horizontal surface. The direction of gravity is indicated as a Z axis, and directions along a surface intersecting the Z axis are indicated as an X axis and a Y axis. The X axis, the Y axis, and the Z axis be perpendicular to each other, and the X axis and the Y axis are along the horizontal plane. In the following description, an X axis direction is referred to as a width direction X, a Z axis direction is referred to as a vertical direction Z, and a direction perpendicular to the width direction X and along the transport path 17 is referred to as a first transport direction Y1. The first transport direction Y1 is a direction in which the transport roller pair 19 transports the medium 12, and is a direction from the printing device 13 on an upstream side toward a post-processing apparatus 14 on a downstream side.

Cassettes 21 that can accommodate the medium 12 in a stacked state are detachably provided in the printing device 13. The plurality of cassettes 21 may be detachably provided in the printing device 13. The printing device 13 includes a pickup roller 22 that sends the uppermost medium 12 among the medium 12 accommodated in the cassette 21 and a separation roller 23 that separates the medium 12 sent out by the pickup roller 22 one by one.

The printing device 13 includes a support portion 25 that is provided at a position along the transport path 17 and supports the medium 12, and a recording head 27 that performs recording by ejecting a liquid from a nozzle 26 onto the medium 12 supported by the support portion 25. The recording head 27 is provided at a position facing the support portion 25 across the transport path 17. The recording head 27 may be a so-called line head capable of simultaneously ejecting a liquid along the width direction X or may be a so-called serial head that ejects a liquid while moving in the width direction X.

The printing device 13 includes a discharge path 101 as a part of the transport path 17, through which the medium 12 is discharged, a switchback path 102 through which the medium 12 is switch-back-transported, and a reversing path 103 through which a posture of the medium 12 is reversed. The discharge path 101 is a path through which the medium 12 recorded by the recording head 27 is discharged toward a discharge portion 104. The discharge portion 104 is located at an upper portion of the printing device 13. The medium 12 transported along the discharge path 101 is placed on the discharge portion 104.

The switchback path 102 and the reversing path 103 are paths through which the duplex printed medium 12 is transported. The switchback path 102 extends along the discharge path 101. The reversing path 103 extends from the switchback path 102. The reversing path 103 extends from a downstream side of the recording head 27 to an upstream side of the recording head 27 so as to pass above the recording head 27.

When duplex printing is executed, the medium 12, one surface of which is printed, is first transported to the switchback path 102. Next, the medium 12 is switch-back-transported in the switchback path 102. That is, the medium 12 is transported in an opposite direction in the switchback path 102. Next, the medium 12 is transported from the switchback path 102 to the reversing path 103.

As the switchback path 102 or the reversing path 103 is transported, the medium 12 is reversed from a posture in which the printed one surface faces the upper side to a posture in which the printed one surface faces the lower side. The medium 12 transported along the reversing path 103 is recorded again by the recording head 27. At this time, a surface of the medium 12, which is opposite to the already printed surface, is printed. In this manner, the printing device 13 executes duplex printing on the medium 12. The printing device 13 transports the printed medium 12 toward the discharge portion 104 or the intermediate device 15.

The intermediate device 15 includes, as a part of the transport path 17, an introduction path 201, a first switchback path 202, a second switchback path 203, a first junction path 204, a second junction path 205, and a deviation path 206. The introduction path 201 is a path through which the medium 12 is introduced from the printing device 13. The first switchback path 202 and the second switchback path 203 are paths which extend from the introduction path 201 and through which the medium 12 is switch-back-transported. The first switchback path 202 and the second switchback path 203 extend to branch from the introduction path 201.

The first junction path 204 is a path extending from the first switchback path 202. The second junction path 205 is a path extending from the second switchback path 203. The deviation path 206 is a path which extends from the first junction path 204 and the second junction path 205 and from which the medium 12 is derived toward the post-processing apparatus 14. The first junction path 204 and the second junction path 205 are joined to each other at the deviation path 206.

The medium 12 transported from the printing device 13 to the intermediate device 15 is transported along the introduction path 201. The medium 12 transported along the introduction path 201 is transported toward the first switchback path 202 and the second switchback path 203. The medium 12 transported along the introduction path 201 is distributed to the first switchback path 202 and the second switchback path 203 by a flap or the like provided at a location branching from the introduction path 201 to the first switchback path 202 and the second switchback path 203.

The medium 12 transported to the first switchback path 202 is switch-back-transported in the first switchback path 202. When being switch-back-transported in the first switchback path 202, the medium 12 is transported to the first junction path 204. The medium 12 transported along the first junction path 204 is transported to the deviation path 206.

The medium 12 transported from the introduction path 201 to the second switchback path 203 is switch-back-transported in the second switchback path 203. When being switch-back-transported in the second switchback path 203, the medium 12 is transported to the second junction path 205. The medium 12 transported along the second junction path 205 is transported to the deviation path 206.

The medium 12 transported through the intermediate device 15 is switch-back-transported in the first switchback path 202 and the second switchback path 203. Therefore, the medium 12 transported through the intermediate device 15 is reversed from a posture in which a surface printed immediately before faces the upper side to a posture in which the surface printed immediately before faces the lower side, in the printing device 13. Accordingly, the medium 12 deviated by the post-processing apparatus 14 is in a posture in which the surface printed immediately before faces the lower side in the printing device 13. As the medium 12 is transported to the intermediate device 15, a drying time of the medium 12 to which a liquid is ejected is ensured. As the drying time of the medium 12 is ensured, transfer of the liquid discharged to the medium 12, curling of the medium 12 due to moisture of the discharged liquid, and the like can be suppressed.

Next, an embodiment of the post-processing apparatus 14 will be described.

As illustrated in FIG. 1, the post-processing apparatus 14 includes a transport mechanism 30 that transports the medium 12 while the medium 12 is clinging onto a loop shaped transport belt 29 and a detection unit 31 that detects the medium 12 located on an upstream side of the transport mechanism 30 in the first transport direction Y1. The post-processing apparatus 14 includes an intermediate stacker 32 as an example of a stacker for stacking the medium 12 transported by the transport belt 29. The post-processing apparatus 14 includes a post-processing mechanism 33 for post-processing the medium 12 stacked on the intermediate stacker 32 and a discharge stacker 34 on which the medium 12 sent out from the intermediate stacker 32 is stacked.

Figure 2:
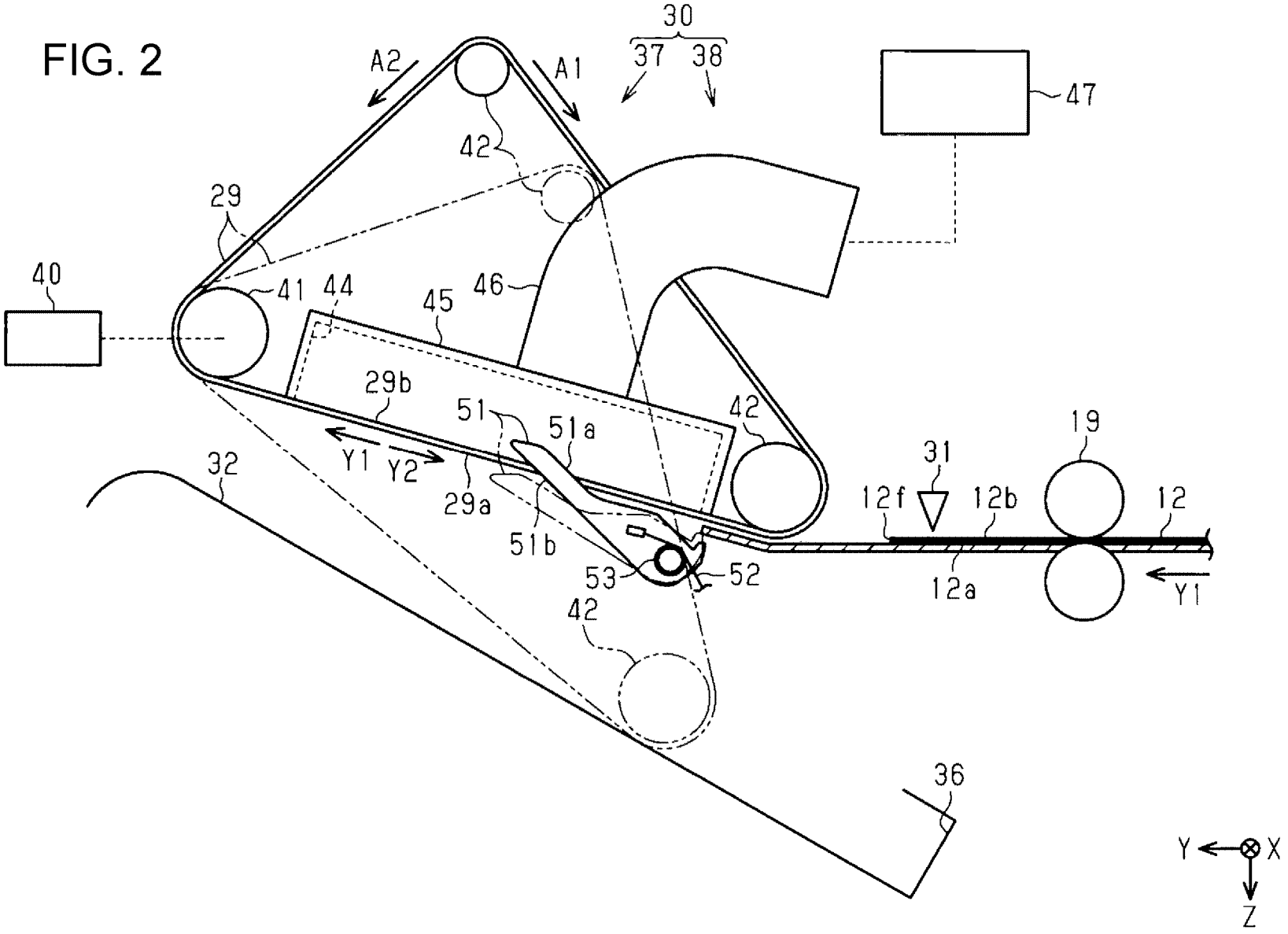
FIG. 2 is a schematic side view of a transport mechanism and an intermediate stacker of the post-processing apparatus.

As illustrated in FIG. 2, the intermediate stacker 32 includes an alignment unit 36 that aligns the end of the stacked medium 12. The intermediate stacker 32 is obliquely provided such that an end thereof on the alignment unit 36 side is located on a lower side of an opposite end in a vertical direction Z.

The transport mechanism 30 is provided such that the intermediate stacker 32 and the transport belt 29 face each other on an upper side of the intermediate stacker 32 in the vertical direction Z. The transport mechanism 30 includes a rotation mechanism 37 that rotates the transport belt 29 and an clinging mechanism 38 that causes the medium 12 recorded by the recording head 27 to cling to the loop transport belt 29.

The rotation mechanism 37 includes a belt motor 40 that rotates the transport belt 29, a driving pulley 41 that rotates by driving of the belt motor 40, and a driven pulley 42 that is rotatable about an axial line that is parallel to an axial line of the driving pulley 41. The rotation mechanism 37 according to the present embodiment includes two driven pulleys 42. The transport belt 29 is hung and transported on a triangular ring including the driving pulley 41 and the driven pulleys 42. The transport belt 29 circulates outside the driving pulley 41 and the driven pulleys 42 by driving the belt motor 40. In detail, as the belt motor 40 is rotated forward, the rotation mechanism 37 rotates the transport belt 29 in a first rotation direction A1. As the belt motor 40 is rotated rearward, the rotation mechanism 37 rotates the transport belt 29 in a second rotation direction A2 that is opposite to the first rotation direction A1.

The transport mechanism 30 is provided rotatably about the driving pulley 41. That is, the transport belt 29 is provided to be displaceable between a contact position indicated by a two-dot chain line of FIG. 2 where the transport belt 29 comes into contact with the medium 12 stacked on the intermediate stacker 32 and a retraction position indicated by a solid line of FIG. 2 where the transport belt 29 is separated further from the intermediate stacker 32 than the contact position.

The clinging mechanism 38 includes the transport belt 29, a suction portion 45 having a suction chamber 44, and a fan 47 that sucks an inside of the suction chamber 44 via a duct 46. An outer surface of the transport belt 29 is a clinging surface 29*a* that causes the medium 12 to cling to the transport belt 29. The suction portion 45 is provided in a state of being in contact with an inner surface 29*b* that is an inner surface of the transport belt 29 such that a part of the suction chamber 44 is covered by the transport belt 29.

Figure 3:
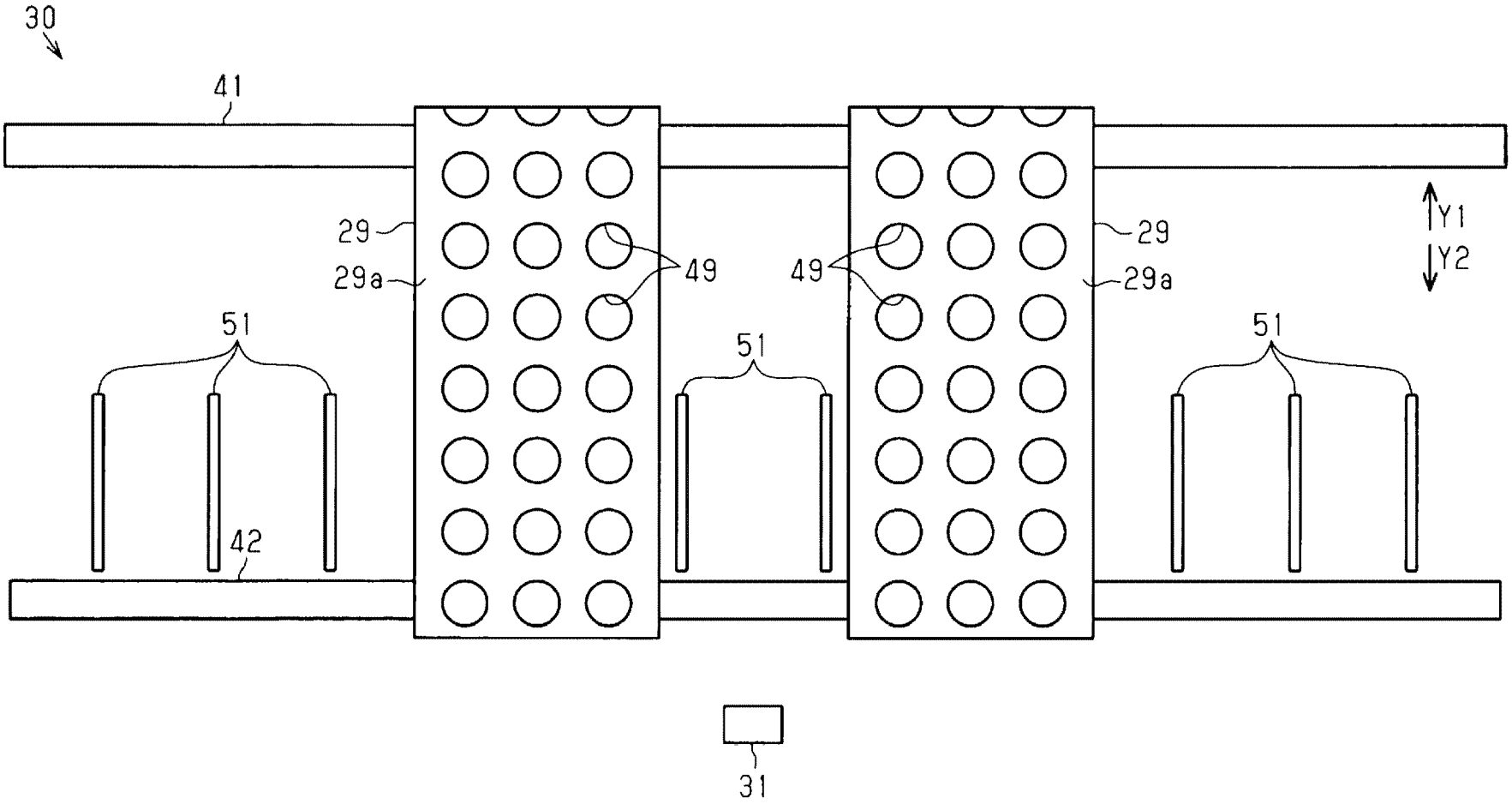
FIG. 3 is a schematic bottom view of a transport belt.

As illustrated in FIG. 3, the plurality of transport belts 29 may be hung on the driving pulley 41 and the driven pulley 42 side by side in the width direction X. A large number of holes 49 passing through the transport belt 29 to open the clinging surface 29*a* and the inner surface 29*b* are formed in the transport belt 29.

As illustrated in FIGS. 2 and 3, the clinging mechanism 38 causes an inside of the suction chamber 44 to have a negative pressure as the fan 47 is driven, and cling the medium 12 to the clinging surface 29*a* of the transport belt 29 through a hole 49 communicating with the suction chamber 44. That is, the clinging mechanism 38 cling the medium 12 to the transport belt 29 in a suction method of sucking air from the holes 49 formed in the transport belt 29.

As illustrated in FIG. 2, the transport mechanism 30 cling the medium 12 to the transport belt 29, rotates the transport belt 29 in this state, and transports the medium 12 in a region between the transport belt 29 and the intermediate stacker 32. In detail, the rotation mechanism 37 rotates the transport belt 29, to which the medium 12 is cling, in the first rotation direction A1, to transport the medium 12 in the first transport direction Y1. The rotation mechanism 37 rotates the transport belt 29, to which the medium 12 is cling, in the second rotation direction A2, to transport the medium 12 in the second transport direction Y2 that is opposite to the first transport direction Y1. After transporting the medium 12 in the first transport direction Y1, the rotation mechanism 37 transports the medium 12 in the second transport direction Y2 and stacks the medium 12 on the intermediate stacker 32.

Next, an embodiment of a separation flap 51 will be described.

As illustrated in FIG. 2, the post-processing apparatus 14 includes at least one separation flap 51 that detaches the medium 12 transported in the second transport direction Y2 from the transport belt 29, and an urging member 52, such as a torsion spring, that urges the separation flap 51. The post-processing apparatus 14 of the present embodiment includes eight separation flaps 51 arranged side by side at intervals in the width direction X. Each of the separation flaps 51 has a flap-upper surface 51*a* which is an example of a first flap surface and a flap-lower surface 51*b* which is an example of a second flap surface.

Among the plurality of separation flaps 51, the separation flap 51 interposed between the pair of transport belts 29 acts to separate the medium 12 from the transport belts 29 in common for all the medium 12 to be transported. Meanwhile, among the plurality of separation flaps 51, the separation flap 51 not interposed between the pair of transport belts 29 acts to cause at least a pair of separation flaps 51 to come into contact with a side end portion of the medium 12 so as to separate the medium 12 from the transport belts 29. Accordingly, even when the media 12 having different sizes are transported, the media 12 can be properly separated from the transport belts 29. Therefore, it is preferable that a position of the separation flap 51 not interposed between the pair of transport belts 29 be determined according to a plurality of standard sizes of the medium 12 considered to be transported.

The separation flap 51 swings about a flap shaft 53, and is provided such that a posture thereof can be changed. The separation flap 51 can be located at a first flap position indicated by a solid line of FIG. 2 and a second flap position indicated by a two-dot chain line of FIG. 2. The urging member 52 urges the separation flap 51 toward the first flap position. When the separation flap 51 is located at the first flap position, the flap-upper surface 51*a* and the flap-lower surface 51*b* intersect the clinging surface 29*a* of the transport belt 29 when viewed in the width direction X. When the separation flap 51 is located at the first flap position, an angle formed by the flap-upper surface 51*a* and the clinging surface 29*a* is an acute angle, and an angle formed by the flap-lower surface 51*b* and the clinging surface 29*a* is an obtuse angle.

Next, an electrical configuration of the medium processing apparatus 11 will be described.

Figure 4:
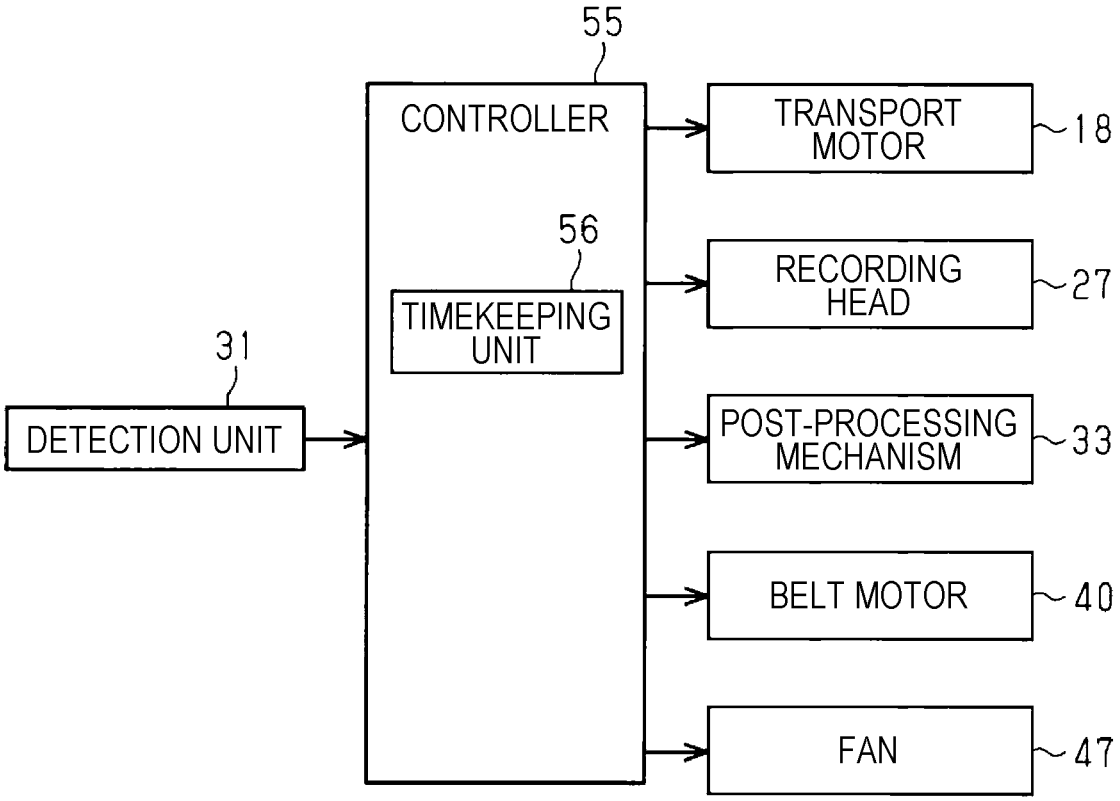
FIG. 4 is a block diagram illustrating an electric configuration of the medium processing apparatus.

As illustrated in FIG. 4, the medium processing apparatus 11 includes a controller 55 that comprehensively controls driving of mechanisms of the medium processing apparatus 11. The controller 55 includes a timekeeping unit 56 that measures a time. The controller 55 is connected to the detection unit 31 so as to receive a signal. The controller 55 transmits a signal to the transport motor 18, the recording head 27, the post-processing mechanism 33, the belt motor 40, and the fan 47, and controls operations of the mechanisms.

Next, an operation of the medium processing apparatus 11 will be described.

As illustrated in FIG. 2, when the detection unit 31 detects the medium 12 transported in the first transport direction Y1 by the transport roller pair 19, the controller 55 drives the fan 47 in a state in which the transport belt 29 is positioned at the retraction position as indicated by the solid line of FIG. 2, and drives the belt motor 40 in forward rotation to rotate the transport belt 29 in the first rotation direction A1.

Figure 5:
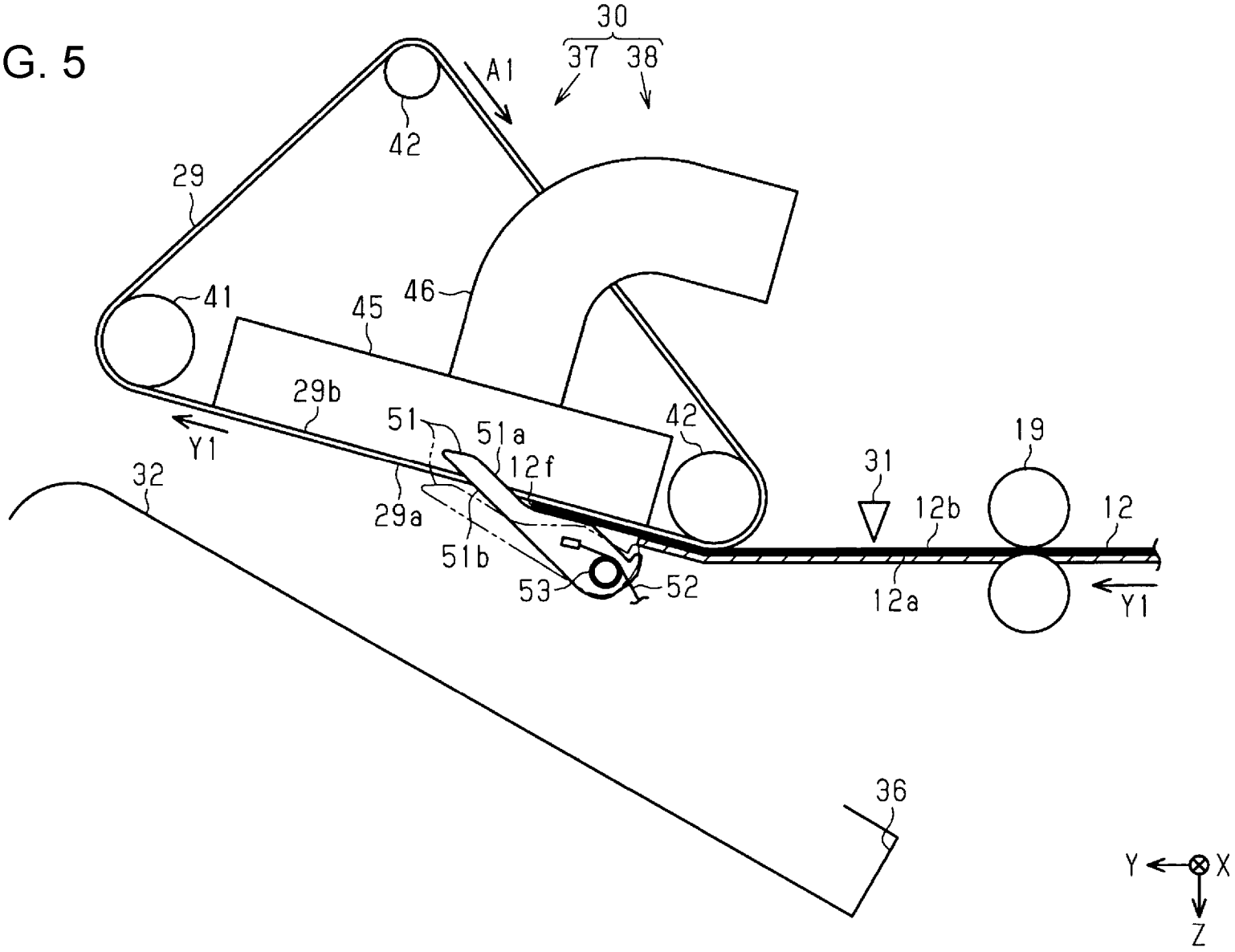
FIG. 5 is a schematic side view of the transport mechanism that causes a medium to cling to the transport belt.

As illustrated in FIG. 5, when the medium 12 is transported to the transport belt 29, the clinging mechanism 38 cling an upper surface 12*b* as an example of a second surface of the medium 12. The upper surface 12*b* of the medium 12 is a surface that is opposite to a lower surface 12*a* as an example of a first surface of the medium 12 on the intermediate stacker 32 side. While being cling to the transport belt 29, the medium 12 is transported in the first transport direction Y1 by the transport belt 29 that rotates in the first rotation direction A1.

When the medium 12 is transported to the separation flap 51, the front end 12*f* of the medium 12, which is an end on a downstream side in the first transport direction Y1, comes into contact with the flap-upper surface 51*a* to push the separation flap 51. Accordingly, the separation flap 51 rotates against an urging force of the urging member 52, and moves to the second flap position indicated by a two-dot chain line of FIG. 5.

Figure 6:
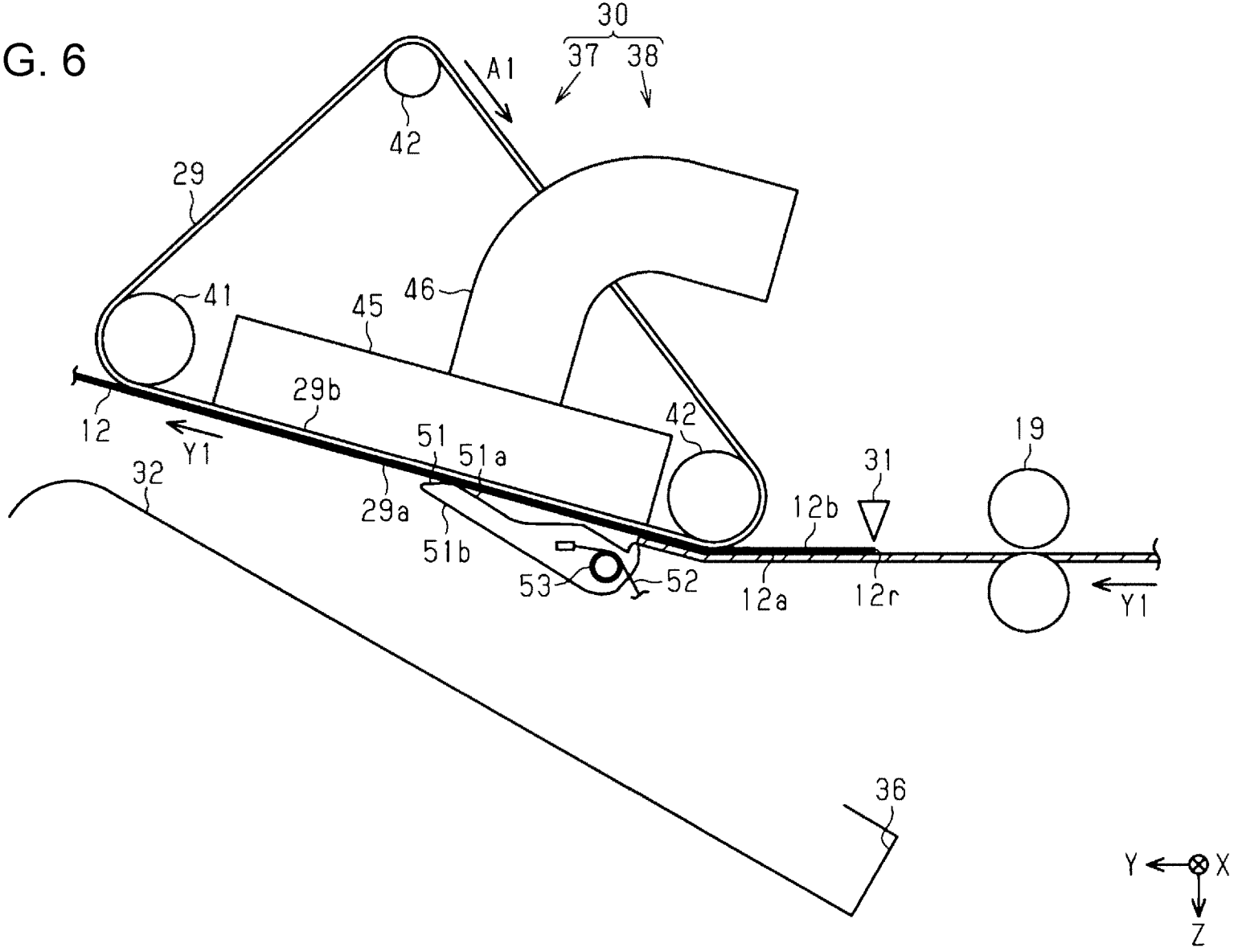
FIG. 6 is a schematic side view of the transport mechanism that transports the cling medium in a first transport direction.

As illustrated in FIG. 6, when the medium 12 transported in the first transport direction Y1 passes through the separation flap 51, at least a part of the flap-upper surface 51*a* comes into contact with the lower surface 12*a* of the medium 12. The medium 12 is pressed against the transport belt 29 by the separation flap 51 urged by the urging member 52 and is transported while being interposed between the separation flap 51 and the transport belt 29.

When the detection unit 31 detects the rear end 12*r*, which is an end of the medium 12 on an upstream side in the first transport direction Y1, the controller 55 drives the belt motor 40 in a reverse rotation after a predetermined time has elapsed. That is, when the rear end 12*r* is detected in a state which the belt motor 40 is driven in forward rotation, the controller 55 continues the forward rotation driving of the belt motor 40 for a predetermined time to rotate the transport belt 29 in the first rotation direction A1. When a predetermined time elapses after the rear end 12*r* is detected, the controller 55 temporarily stops driving of the belt motor 40 and continuously drives the belt motor 40 in the reverse direction to rotate the transport belt 29 in the second rotation direction A2.

The predetermined time is a time required for the rear end 12*r* of the medium 12 to pass through the separation flap 51. The predetermined time is substantially equal to a quotient obtained by dividing a distance from the detection unit 31 to a tip end of the separation flap 51 along the transport path 17 by a speed at which the medium 12 is transported.

Figure 7:
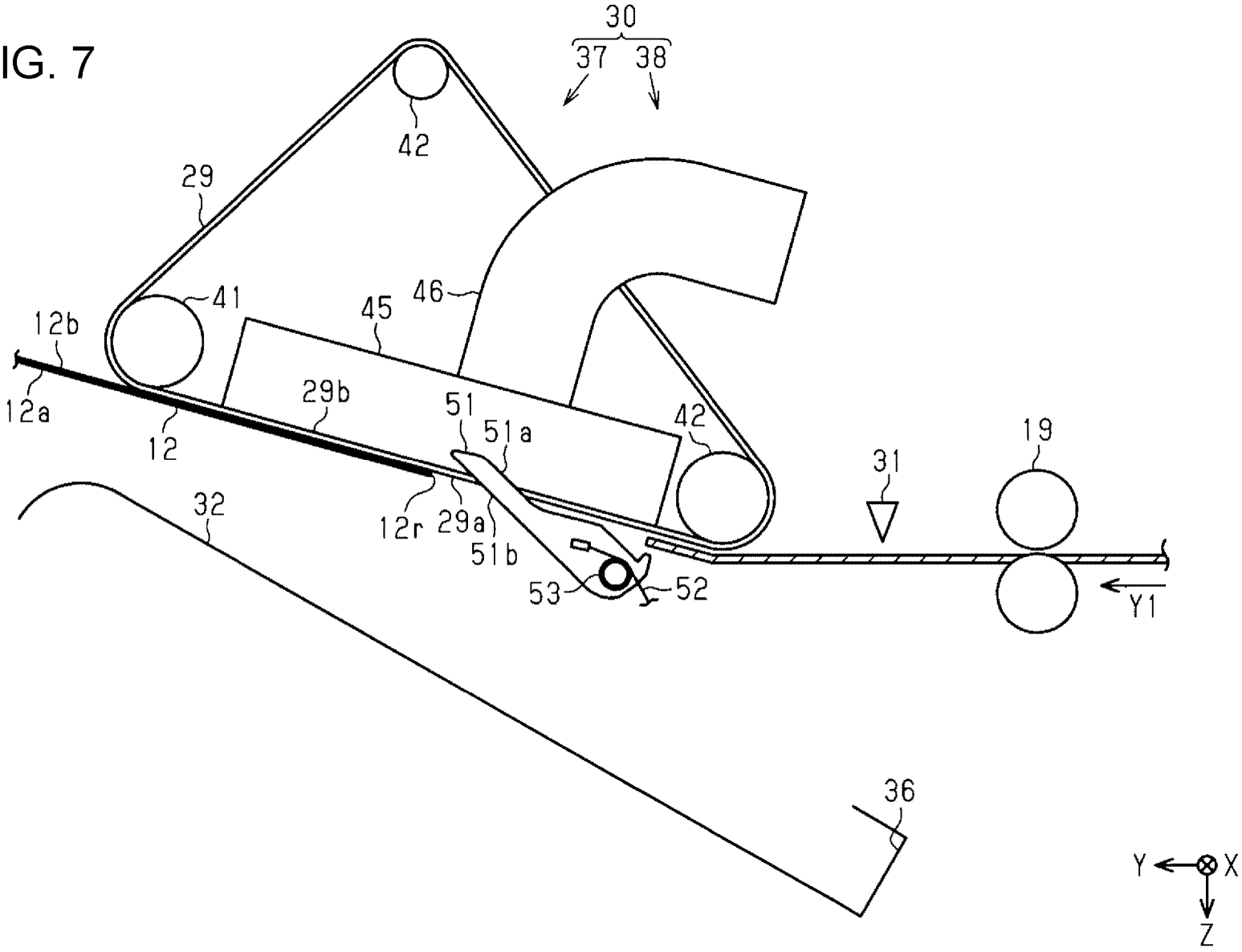
FIG. 7 is a schematic side view of the transport mechanism when a rotation direction of the transport belt is switched.

As illustrated in FIG. 7, when the rotation direction of the transport belt 29 is changed from the first rotation direction A1 to the second rotation direction A2 after the predetermined time elapses, the medium 12 is temporarily stopped in a state in which the rear end 12*r* is positioned on a downstream side of the separation flap 51 in the first transport direction Y1. When the medium 12 is separated from the separation flap 51, the separation flap 51 returns to the first flap position by an urging force of the urging member 52. That is, when the rotation direction of the transport belt 29 is switched from the first rotation direction A1 to the second rotation direction A2, the separation flap 51 is located at the first flap position.

Figure 8:
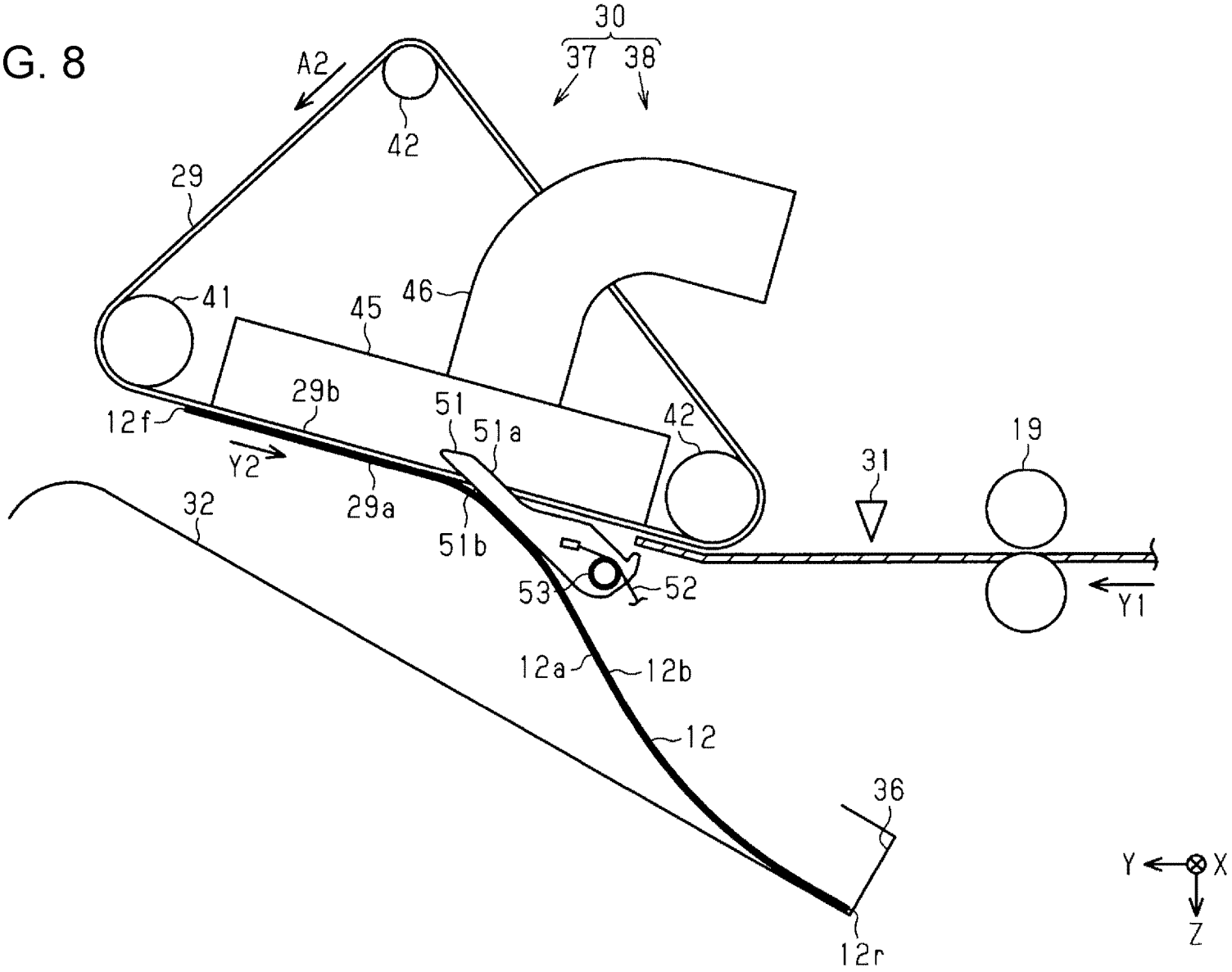
FIG. 8 is a schematic side view of the transport mechanism that transports the medium in a second transport direction.

As illustrated in FIG. 8, when the transport belt 29 rotates in the second rotation direction A2, the medium 12 is transported in the second transport direction Y2. At this time, the separation flap 51 is located at the first flap position, and at least a part of the flap-lower surface 51*b* comes into contact with the upper surface 12*b* of the medium 12 transported in the second transport direction Y2, and detaches the medium 12 from the clinging surface 29*a*. The rear end 12*r* of the medium 12 detached from the clinging surface 29*a* by the separation flap 51 comes into contact with the alignment unit 36 to be positioned, and the medium 12 is stacked on the intermediate stacker 32 positioned on a downstream side of the transport belt 29.

In this way, when the transport belt 29 rotates in the second rotation direction A2, and the medium 12 is transported in the second transport direction Y2, a part of the medium 12 is transported while being cling to the transport belt 29. Thus, a situation in which the medium 12 and the intermediate stacker 32 are separated from each other occurs. Accordingly, for example, a possibility that the lower surface 12*a* of the following medium 12 comes into contact with the upper surface 12*b* of the preceding medium 12 stacked on the intermediate stacker 32 in advance can be reduced.

In particular, in an ink jet printer using an aqueous ink, when a liquid such as an ink adheres to the medium 12, resistance when the media 12 slide together increases. Therefore, in stacking the following medium 12 on the intermediate stacker 32, there is a possibility that when a time during which the lower surface 12*a* of the following medium 12 is in contact with the upper surface 12*b* of the preceding medium 12 is long, the rear end 12*r* of the following medium 12 does not properly contact the alignment unit 36 and the following medium 12 cannot be properly stacked on the intermediate stacker 32, due to sliding resistance between the preceding medium 12 and the following medium 12.

However, as the medium 12 is cling to the transport belt 29, since a possibility that the lower surface 12*a* of the following medium 12 is in contact with the upper surface 12*b* of the preceding medium 12 stacked on the intermediate stacker 32 in advance can be reduced, the following medium 12 can be properly stacked on the intermediate stacker 32.

Figure 9:
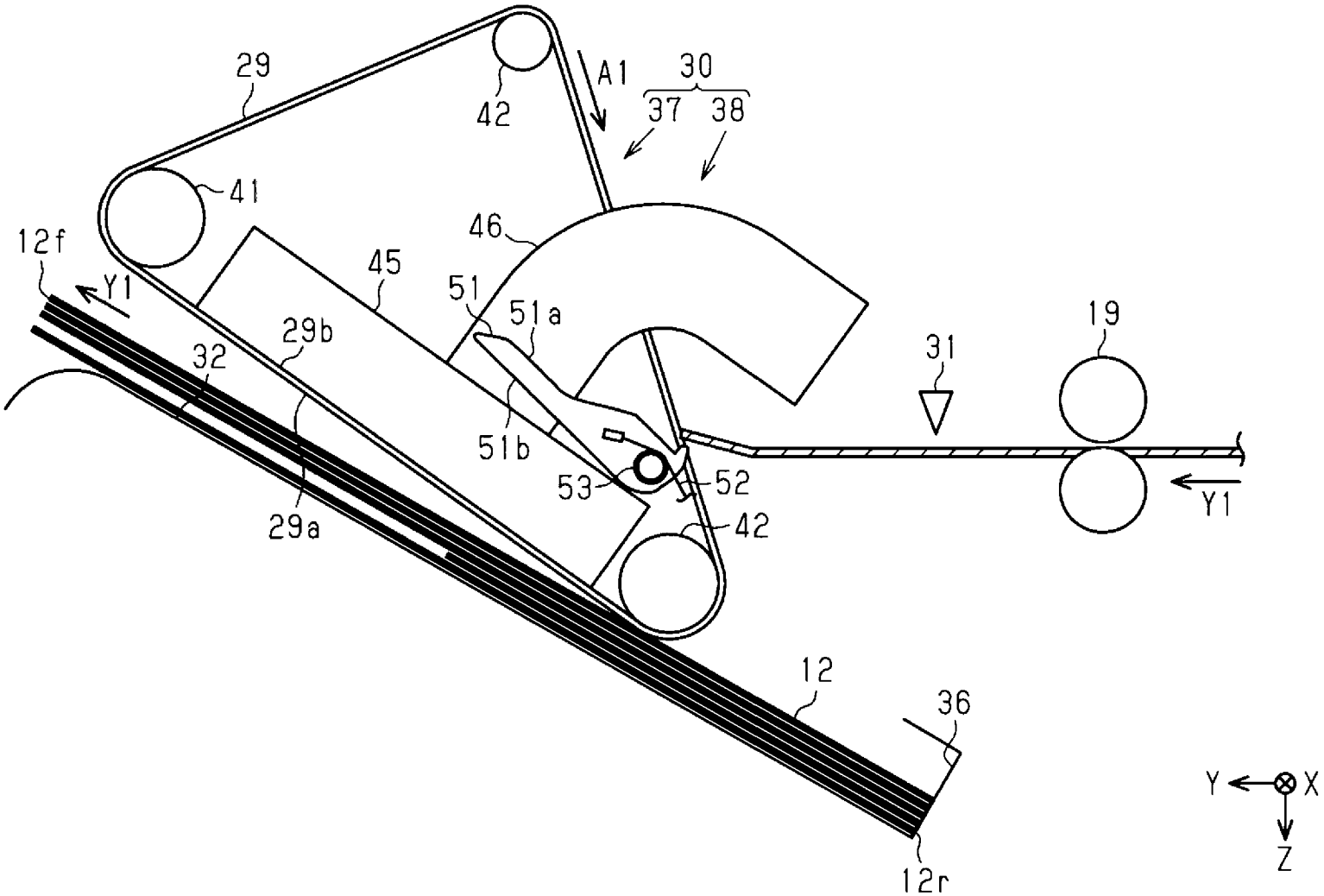
FIG. 9 is a schematic side view illustrating a transport belt positioned at a contact position.

As illustrated in FIG. 9, the medium 12 is stacked such that the rear end 12*r* is aligned with the alignment unit 36 regardless of the size of the medium 12 in the first transport direction Y1. When a predetermined number of the media 12 (the number of the media 12 per copy when the medium 12 is post-processed) are stacked on the intermediate stacker 32, the post-processing mechanism 33 performs post-processing on the medium 12, and the controller 55 positions the transport belt 29 at the contact position. The controller 55 may perform the post-processing on the medium 12 in a state in which the transport belt 29 is in contact with the medium 12 stacked on the intermediate stacker 32 or may bring the transport belt 29 into the post-processed medium 12.

The controller 55 drives the belt motor 40 in the forward rotation in a state in which the transport belt 29 is in contact with the post-processed medium 12. That is, after the post-processing mechanism 33 performs post-processing, the rotation mechanism 37 rotates the transport belt 29 located at the contact position in the first rotation direction A1. The medium 12 stacked on the intermediate stacker 32 is sent out from the intermediate stacker 32 in the first transport direction Y1, and is stacked on the discharge stacker 34.

According to the above-described embodiment, the following effects can be obtained.

(1-1) After transporting the medium 12 in the first transport direction Y1, the rotation mechanism 37 transports the medium 12 in the second transport direction Y2 and stacks the medium 12 on the intermediate stacker 32. Therefore, a transport speed of the medium 12 is reduced at a timing when the transport direction of the medium 12 is switched from the first transport direction Y1 to the second transport direction Y2. Therefore, when the transport direction of the medium 12 is switched from the first transport direction Y1 to the second transport direction Y2, a time required for stacking the medium 12 on the intermediate stacker 32 is long, as a compared to a case where the medium 12 is stacked on the intermediate stacker 32 while the first transport direction Y1 is maintained. That is, when the transport direction of the medium 12 is switched from the first transport direction Y1 to the second transport direction Y2, a time required for drying a liquid attached to the medium 12 is long. Thus, the discharged following medium 12 is easy to slide on the medium 12 already stacked on the intermediate stacker 32, and improvement of alignment of the following medium 12 can be expected. Therefore, even when the medium 12 recorded by ejecting the liquid is stacked on the intermediate stacker 32, the alignment can be ensured.

(1-2) Since the separation flap 51 comes into contact with the lower surface 12*a* of the medium 12 transported in the first transport direction Y1, the medium 12 can be stably transported while being interposed between the separation flap 51 and the transport belt 29. The flap-lower surface 51*b* of the separation flap 51 intersects the clinging surface 29*a* of the transport belt 29 when the rotation direction of the transport belt 29 is switched from the first rotation direction A1 to the second rotation direction A2. Therefore, when the medium 12 is transported in the second transport direction Y2 by the transport belt 29, the upper surface 12*b* comes into contact with the separation flap 51, and the medium 12 is detached from the transport belt 29. Therefore, the transport of the medium 12 and the stacking on the intermediate stacker 32 can be more efficiently performed by the separation flap 51, of which a posture can be changed.

(1-3) Since an angle between the flap-lower surface 51*b* and the clinging surface 29*a* is an obtuse angle, the medium 12 can be easily detached from the transport belt 29, as compared to a case where an angle between the flap-lower surface 51*b* and the clinging surface 29*a* is an acute angle.

(1-4) The clinging mechanism 38 cling the medium 12 to the transport belt 29 by a suction method. Therefore, for example, as compared to a case where the medium 12 is transported by a clinging belt, a possibility that the medium 12 is damaged can be reduced.

(1-5) The intermediate stacker 32 includes the alignment unit 36, and an end of the intermediate stacker 32 on the alignment unit 36 side is located on a lower side in the vertical direction Z than an opposite end thereof. Therefore, the alignment when the medium 12 is stacked on the intermediate stacker 32 can be further improved.

(1-6) The transport belt 29 is provided to be displaceable between a contact position where the transport belt 29 is in contact with the medium 12 stacked on the intermediate stacker 32 and a retraction position where the transport belt 29 is separated further from the intermediate stacker 32 than the contact position. When the transport belt 29 located at the contact position rotates in the first rotation direction A1, the medium 12 stacked on the intermediate stacker 32 can be sent out from the intermediate stacker 32. Therefore, the stacking of the medium 12 on the intermediate stacker 32 and the sending-out of the medium 12 from the intermediate stacker 32 can be performed by the transport belt 29.

(1-7) Frictional resistance when the media 12 to which the liquid adheres by a recording process overlap with each other is larger than frictional resistance when the media 12 to which the liquid does not adhere overlap each other. Therefore, when the medium 12 after the recording process slides and is stacked on the previously recorded medium 12, the medium 12 may not be aligned. In this point, the transport mechanism 30 is located above the intermediate stacker 32 in the vertical direction Z, drops the medium 12 from above, and stacks the medium 12 on the intermediate stacker 32. Therefore, even when the recorded medium 12 having high frictional resistance is stacked on the intermediate stacker 32, the medium 12 can be aligned and stacked.

(1-8) After transporting the medium 12 in the first transport direction Y1, the rotation mechanism 37 transports the medium 12 in the second transport direction Y2 and stacks the medium 12 on the intermediate stacker 32. Therefore, the medium 12 is stacked on the intermediate stacker 32 such that the rear end 12*r* on an upstream side in the first transport direction Y1 is aligned. Therefore, even when the media 12 having different sizes are stacked, the media 12 can be stacked while a variation in position is reduced.

Second Embodiment

Next, a medium processing apparatus and a post-processing apparatus according to a second embodiment will be described with reference to the drawings. A configuration in which a medium is sent out from an intermediate stacker according to the second embodiment is different from that according to the first embodiment. Thus, since the other configuration is substantially the same as that according to the first embodiment, the same configuration is designated by the same reference numeral, and duplicated description thereof will be omitted.

Figure 10:
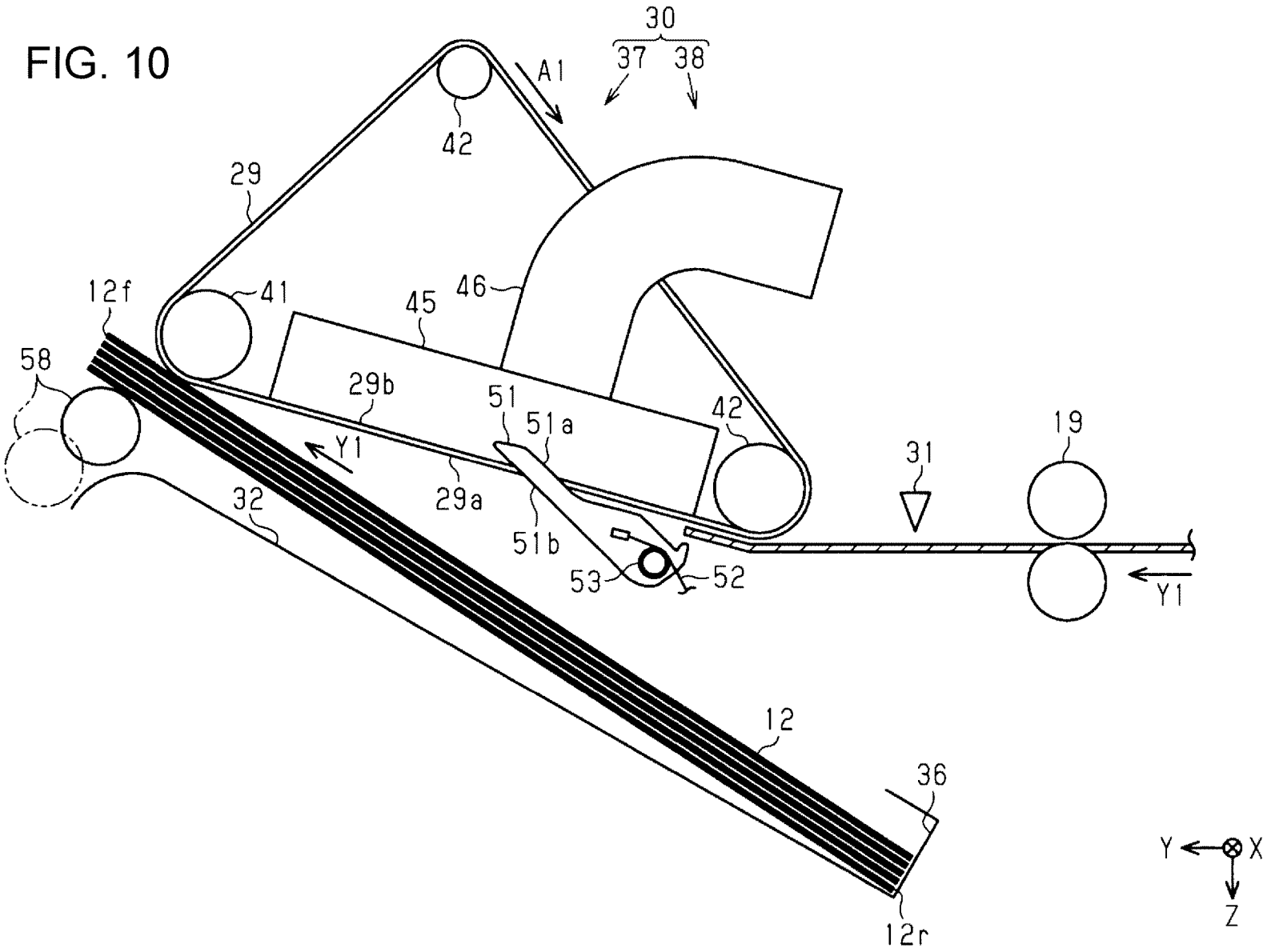
FIG. 10 is a schematic side view illustrating the post-processing apparatus according to a second embodiment.

As illustrated in FIG. 10, the post-processing apparatus 14 may include a sending-out roller 58 that sends out the medium 12 stacked on the intermediate stacker 32. The sending-out roller 58 is provided to be displaceable between a contact position indicated by a solid line of FIG. 10 where the medium 12 stacked on the intermediate stacker 32 comes into contact with the transport belt 29 and a retraction position indicated by a two-dot chain line of FIG. 10 where the sending-out roller 58 is separated further from the transport belt 29 than the contact position. The controller 55 drives a not-illustrated movement mechanism to move the sending-out roller 58.

Next, an operation of the medium processing apparatus 11 will be described.

In a state in which the sending-out roller 58 is located in the retraction position, the rotation mechanism 37 rotates the transport belt 29 in the first rotation direction A1 or the second rotation direction A2 to stack the medium 12 on the intermediate stacker 32, which is similar to the first embodiment.

As illustrated in FIG. 10, after the post-processing mechanism 33 performs the post-processing, the controller 55 positions the sending-out roller 58 at the contact position to drive the belt motor 40 in the forward rotation. That is, the rotation mechanism 37 rotates the transport belt 29 in the first rotation direction A1 in a state in which the sending-out roller 58 is located at the contact position. The medium 12 stacked on the intermediate stacker 32 is sent out from the intermediate stacker 32 in the first transport direction Y1, and is stacked on the discharge stacker 34.

According to the above-described second embodiment, in addition to the effects of the above-described first embodiment, the following effects can be obtained.

(2-1) The sending-out roller 58 is located at a contact position where the medium 12 stacked on the intermediate stacker 32 is in contact with the transport belt 29 and a retraction position where the medium 12 is separated further from the transport belt 29 than the contact position. The sending-out roller 58 located at the contact position sandwiches the medium between the sending out roller 58 and the transport belt 29. Therefore, when the transport belt 29 is rotated in the first rotation direction A1 in a state in which the sending-out roller 58 is located at the contact position, the medium 12 is sent out from the intermediate stacker 32 by the transport belt 29 and the sending-out roller 58.

The above-described embodiment may be changed to modifications described below. The above-described embodiment and the following modifications may be combined with each other in a predetermined manner. Configurations included in the following modifications may be combined with each other in a predetermined manner.

The post-processing apparatus 14 may be configured so as not to include the urging member 52. For example, the separation flap 51 may have a weight at a position that is opposite to a side of the flap shaft 53, which is in contact with the medium 12, and the separation flap 51 positioned at the second flap position may return to the first flap position by a weight thereof. The post-processing apparatus 14 may have, for example, a solenoid that moves the separation flap 51 and a driving source that moves the separation flap 51, such as a motor that rotates the flap shaft 53.

The post-processing apparatus 14 may include a roller that interposes the medium 12 between the post-processing apparatus 14 and the transport belt 29 and is driven to rotate as the medium 12 is transported. When the roller is a toothed roller having unevennesses formed on a peripheral surface thereof, a concern that the liquid adhering to the lower surface 12*a* of the duplex printed medium 12 is moved to the roller can be reduced.

The post-processing apparatus 14 may include a presser that presses the medium 12 stacked on the intermediate stacker 32. The presser is configured with a plate-like elastic member rotatably provided or a weight displaceably provided. The presser presses the medium 12 stacked on the intermediate stacker 32 when the transport belt 29 rotates in the first rotation direction A1, and moves to a position separated from the medium 12 when the transport belt 29 rotates in the second rotation direction A2.

The post-processing mechanism 33 may perform, as post-processing, a predetermined process such as a punch process of opening a hole in the medium 12, a shift process of moving and discharging the medium 12 in sheet units, a cutting process of cutting the medium 12, a signature process of folding the medium 12, a bookbinding process of bookbinding the medium 12, and a collating process.

The clinging mechanism 38 may cling the medium 12 to the transport belt 29 by an electrostatic clinging unit in which the medium 12 and the transport belt 29 are charged.

When the separation flap 51 is located at the first flap position, an angle between the flap-upper surface 51*a* and the clinging surface 29*a* may be a right angle or an obtuse angle. When the separation flap 51 is located at the first flap position, an angle between the flap-lower surface 51*b* and the clinging surface 29*a* may be a right angle or an obtuse angle.

When the rotation direction of the transport belt 29 is switched from the first rotation direction A1 to the second rotation direction A2, the separation flap 51 is located at the second flap position.

That is, when the rotation direction of the transport belt 29 is switched from the first rotation direction A1 to the second rotation direction A2, the flap-lower surface 51*b* may not intersect the clinging surface 29*a*.

The separation flap 51 may not be in contact with the medium 12 transported in the first transport direction Y1.

The post-processing apparatus 14 may be configured so as not to include the separation flap 51. For example, the post-processing apparatus 14 may detach the medium 12 from the clinging surface 29*a* by stopping the driving of the fan 47.

The medium processing apparatus 11 may be an apparatus integrally having a function of the intermediate device 15, a function of the post-processing apparatus 14, and a function of the printing device 13.

The medium processing apparatus 11 may be an apparatus including a device integrally having a function of the intermediate device 15 and a function of the post-processing apparatus 14 and the printing device 13.

The medium processing apparatus 11 may be configured not to include the intermediate device 15 and the post-processing apparatus 14, and the transport mechanism 30 and a stacker on which the medium 12 transported by the transport mechanism 30 is stacked may be provided in the printing device 13. The medium processing apparatus 11 may be configured not to include the post-processing mechanism 33. The medium processing apparatus 11 may be stacked on the stacker of the printing device 13 such that the medium 12 recorded by the recording head 27 is transported in the first transport direction Y1 and the second transport direction Y2 by the transport mechanism 30 and the rear end 12*r* of the medium 12 is aligned.

The liquid, which is attached to the medium 12, can be selected in a predetermined manner as long as the liquid can be printed on the medium 12. The material is in a liquid phase state, and includes a fluid-state body such as liquid having high viscosity or low viscosity, sol, gel water, other inorganic solvents, an organic solvent, a solution, liquid resin, and liquid metal (metal melt). Further, the state of the material includes a solution obtained by dissolving, dispersing, and mixing, in a solvent, particles of a functional material made of a solid such as a pigment or metal particles, in addition to the liquid. Representative examples of liquids include an ink. The ink includes various kinds of liquid compositions such as general water-based ink and oil-based ink, gel ink, hot melt ink and the like.

The medium processing apparatus 11 is an apparatus that attaches a liquid such as an ink to the medium 12, and prints an image such as a letter, a picture, and a photograph, and may be a serial printer, a lateral printer, a page printer, and the like. Further, the printing device may be an offset printing device, a textile printing device, or the like.

What is claimed is:

1. A medium transporting apparatus comprising:

a transport belt that has a loop shape;

a clinging mechanism that causes a medium to cling to the transport belt;

a rotation mechanism that rotates the transport belt in a first rotation direction and a second rotation direction that is opposite to the first rotation direction; and a stacker on which the medium transported by the transport belt is stacked, wherein the clinging mechanism causes a second surface that is opposite to a first surface of the medium on the stacker side to cling to the transport belt, and wherein after rotating the transport belt in the first rotation direction to transport the medium in a first transport direction, the rotation mechanism rotates the transport belt in the second rotation direction to transport the medium in a second transport direction that is opposite to the first transport direction so as to stack the medium on the stacker, wherein the medium transporting apparatus further comprises:

a flap that has a flap shaft on an upstream side in the first transport direction, and is swingable between a first position not intersecting the second surface of the medium which is caused to cling to the transport belt and a second position intersecting the second surface when viewed from a width direction that is perpendicular to the first transport direction; and a pressing member that presses the flap toward the second position, wherein the flap includes:

a first flap surface that configured to contact with the first surface of the medium transported in the first transport direction, when the flap is located in the first position, and a second flap surface that configured to contact with the second surface of the medium transported in the second transport direction and detach the medium from the transport belt, when the flap is located in the second position.

2. The medium transporting apparatus according to claim 1, wherein an angle between the second flap surface and the second surface when the transport belt rotates in the second rotation direction is an obtuse angle.

3. The medium transporting apparatus according to claim 1, wherein the clinging mechanism causes the second surface of the medium to cling to the transport belt by a suction unit of sucking air through a hole formed in the transport belt or an electrostatic clinging unit of charging the medium and the transport belt.

4. The medium transporting apparatus according to claim 1, wherein the stacker includes an alignment unit that aligns an end of the medium, and wherein an end of the stacker on the alignment unit side is located lower in a vertical direction than an opposite end of the stacker.

5. A post-processing apparatus comprising:

a transport belt that has a loop shape;

a clinging mechanism that causes a medium to cling to the transport belt;

a rotation mechanism that rotates the transport belt in a first rotation direction and a second rotation direction that is opposite to the first rotation direction;

an intermediate stacker on which the medium transported by the transport belt is stacked;

a post-processing mechanism that performs post-processing on the medium in the intermediate stacker; and a discharge stacker on which the medium transported from the intermediate stacker is stacked, wherein the clinging mechanism causes a second surface that is opposite to a first surface of the medium on the intermediate stacker side to cling to the transport belt, and wherein after rotating the transport belt in the first rotation direction to transport the medium in the first transport direction, the rotation mechanism rotates the transport belt in the second rotation direction to transport the medium in a second transport direction that is opposite to the first transport direction so as to stack the medium on the intermediate stacker, wherein the transport belt is displaceable between a contact position where the transport belt is in contact with the medium stacked on the intermediate stacker and a retraction position where the transport belt is separated further away from the intermediate stacker than the contact position, and wherein after the post-processing mechanism performs the post-processing, the rotation mechanism rotates the transport belt located at the contact position in the first rotation direction.

6. A post-processing apparatus comprising:

a transport belt that has a loop shape;

a clinging mechanism that causes a medium to cling to the transport belt;

a rotation mechanism that rotates the transport belt in a first rotation direction and a second rotation direction that is opposite to the first rotation direction;

an intermediate stacker on which the medium transported by the transport belt is stacked;

a post-processing mechanism that performs post-processing on the medium in the intermediate stacker; and a discharge stacker on which the medium transported from the intermediate stacker is stacked, wherein the clinging mechanism causes a second surface that is opposite to a first surface of the medium on the intermediate stacker side to cling to the transport belt, and wherein after rotating the transport belt in the first rotation direction to transport the medium in the first transport direction, the rotation mechanism rotates the transport belt in the second rotation direction to transport the medium in a second transport direction that is opposite to the first transport direction so as to stack the medium on the intermediate stacker, wherein the post-processing apparatus further comprises:

a sending-out roller that is displaceable between a contact position where the medium stacked on the intermediate stacker is in contact with the transport belt and a retraction position where the medium is separated further away from the transport belt than the contact position, wherein the rotation mechanism rotates, in a state in which the sending-out roller is located at the retraction position, the transport belt in the first rotation direction and the second rotation direction, to stack the medium on the intermediate stacker, and after the post-processing mechanism performs the post-processing, rotates the transport belt in the first rotation direction in a state in which the sending-out roller is located at the contact position.

* * * * *